US006385937B1

(12) United States Patent
Alexandre

(10) Patent No.: US 6,385,937 B1
(45) Date of Patent: May 14, 2002

(54) MODULARIZED STRUCTURE FRAMING SYSTEM AND MODULE INSTALLATION TOOLS FOR USE THEREWITH

(76) Inventor: Ian B. Alexandre, 4428 Pinebark Ave., Orlando, FL (US) 32811

( * ) Notice: Subject to any disclaimer, the term of this patent is extended or adjusted under 35 U.S.C. 154(b) by 462 days.

(21) Appl. No.: 08/892,348

(22) Filed: Jul. 14, 1997

(51) Int. Cl.[7] ..... E04B 2/70

(52) U.S. Cl. ..... 52/653.1; 52/656.1; 52/127.2; 52/127.5; 52/481.1; 52/238.1; 52/284; 52/285.1

(58) Field of Search ..... 52/653.1, 656.1, 52/656.2, 581, 582.1, 79.1, 79.12, 127.2, 127.5, 127.6, 127.7, 210, 220.2, 481.1, 270, 238.1, 284, 285.1, 285.2; 269/910

(56) References Cited

U.S. PATENT DOCUMENTS

| | | | | | |
|---|---|---|---|---|---|
| 1,448,244 | A | * | 3/1923 | Wilson | 52/210 X |
| 2,281,402 | A | * | 4/1942 | Wilson, Jr. et al. | 52/210 |
| 2,803,856 | A | * | 8/1957 | Kofahl et al. | 52/238.1 X |
| 3,774,362 | A | * | 11/1973 | Matuschek et al. | 52/238.1 X |
| 3,813,832 | A | * | 6/1974 | Caplan | 52/581 X |
| 3,921,355 | A | * | 11/1975 | Pennecot | 52/284 X |
| 4,059,931 | A | | 11/1977 | Mongan | |
| 4,118,903 | A | * | 10/1978 | Coulthard | 52/238.1 X |
| 4,272,930 | A | * | 6/1981 | Foster | 52/582.1 X |
| 4,281,491 | A | * | 8/1981 | Schonert | 52/481.1 X |
| 4,441,287 | A | | 4/1984 | Muir | |
| 4,514,950 | A | | 5/1985 | Goodson, Jr. | |
| 4,629,171 | A | * | 12/1986 | Judy et al. | 269/910 X |
| 4,677,806 | A | | 7/1987 | Tuomi | |
| 5,297,374 | A | | 3/1994 | Himes | |
| 5,341,611 | A | | 8/1994 | Lewis | |
| 5,353,558 | A | | 10/1994 | Shea, Sr. et al. | |
| 5,596,859 | A | * | 1/1997 | Horton et al. | 52/656.6 X |
| 5,713,176 | A | * | 2/1998 | Hunt | 52/481.1 X |
| 5,819,498 | A | * | 10/1998 | Geraci | 52/745.1 |

* cited by examiner

*Primary Examiner*—Laura A. Callo
(74) *Attorney, Agent, or Firm*—John D. Gugliotta

(57) ABSTRACT

The modularized structure framing system is disclosed incorporating a plurality of quad wall modules, a plurality of single wall modules, a plurality of double wall module, a plurality of window modules, and a plurality of door modules. Each module is,made using conventional 2"×4" building materials. Endpieces of conventional 1"×4" building materials allow modules to be aligned together during construction while still maintaining standard dimensionality. A plurality of alignment tools are provided for installation of the modules. These include a corner alignment tool having a 90 degree angle and a 1.25 inch wide by 3.55 inch deep groove running throughout, a wall straightness tool also having a 1.25 inch wide by 3.55 deep groove running throughout, and a "T"-shaped the wall alignment tool having a 1.25 inch wide by 3.55 deep groove running throughout.

1 Claim, 8 Drawing Sheets

MODULARIZED STRUCTURE FRAMING SYSTEM AND MODULE INSTALLATION TOOLS FOR USE THEREWITH

RELATED APPLICATIONS

The present invention is a continuation of Disclosure Document Number 411,332 filed on Dec. 13, 1996.

BACKGROUND OF THE INVENTION

1. Field of the Invention

The present invention relates generally to building framing and erection methods and, more particularly, to a modularized structure framing system and module erection tools.

2. Description of the Related Art

As is well-known in the art, many methods and devices for aiding in the construction of buildings are known. Due to the high level of labor intensity in the construction of a building, many attempts have been made to speed up the construction process by using pre-fabricated components.

Completely manufactured structures are known as one attempt to insert the benefits of the assembly line into residential construction. For instance, U.S. Pat. No. 5,343,558, issued in the name of Shea, Sr., et al., discloses one such manufactured house unit which includes multiple separable sections. However, such structures have obvious and apparent limits to their adaptability for use in other types of construction of dwellings.

Manufactured components, such as pre-fabricated roofing trusses, have been known and available as another attempt to speed up the framing process. Examples of such prefabricated trusses are disclosed in U.S. Pat. No. 4,441,287, issued in the name of Muir, and in U.S. Pat. No. 4,677,806, issued in the name of Tuomi.

Techniques utilizing more extensive arrangements of members are also known. In U.S. Pat. No. 5,297,374, issued in the name of Himes, and in U.S. Pat. No. 4,059,931, issued in the name of Mongan, examples of such techniques are disclosed for both residential and commercial construction, respectively.

Other framing systems are known that concentrate mostly on providing rapid erection of wall to roofing connections. Examples include U.S. Pat. No. 5,341,611, issued in the name of Lewis, and U.S. Pat. No. 4,514,950, issued in the name of Goodson, Jr.

Although the above methods and devices each provide a modicum of labor savings, none can provide extensive savings during field erection of otherwise unique residential and commercial structures. Consequently, a need has been felt for providing just such an apparatus and method.

SUMMARY OF THE INVENTION

It is therefore an object of the present invention to provide an improved modularized structure framing system.

It is another object of the present invention to provide an improved modularized structure framing system which can be used in conjunction with a plurality of module tools.

It is a feature of the present invention to provide an improved system for framing a new structure in one day using a series of tools to aid in framing erection.

Briefly described according to one preferred embodiment of the present invention, several wood modules and assemblies comprise the modularized structure framing system: single-wall module (94½"-by-16"), double-wall module (94½"-by-32"), quad-wall module (94½"-by-64"), window modules (most common sizes), door modules (most common sizes), corner post assembly, and partition exterior wall intersection assembly. Odd-sized window and door modules are constructed on-site. The modules are constructed of lumber and nails. They can be manufactured by existing wood forming, cutting and attachment technologies. The wall, window and door modules are preconstructed using 1"-by-4"s and 2"-by-4"s. End pieces of each module are 1"-by-4". Both window and door modules have headers. Predrilled holes for electrical wiring are set near the bottom of vertical members in the wall and window modules.

Further, a plurality of alignment tools are provided. The corner alignment tool has a 90 degree angle and a 3.55 inch wide by 1.25 inch deep groove running throughout. The wall straightness tool also has a 3.55 inch wide by 1.25 inch deep groove as does the "T"-shaped wall alignment tool.

An advantage of the present invention is that the simple design can be used in conjunction with existing tools and products.

Another advantage of the present invention is that modules and assemblies can be fabricated which meet most standard construction sizes.

Yet another advantage of the present invention is that it can be easily assembled into a complete frame structure.

Further, the present invention saves time, and therefore labor costs, by allowing rapid erection. Different module styles can be formed which meet a variety of needs, from different wall sizes to windows and doors, and a single story structure can be easily "dried in" in as little as two working days.

Advantages of the alignment tools are many, in that they prevent accidentally going out of square, provide a means to ensure verticality, straightness and 90-degree angles, and are easily moved and shifted to different locations as a job progresses.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 4A:
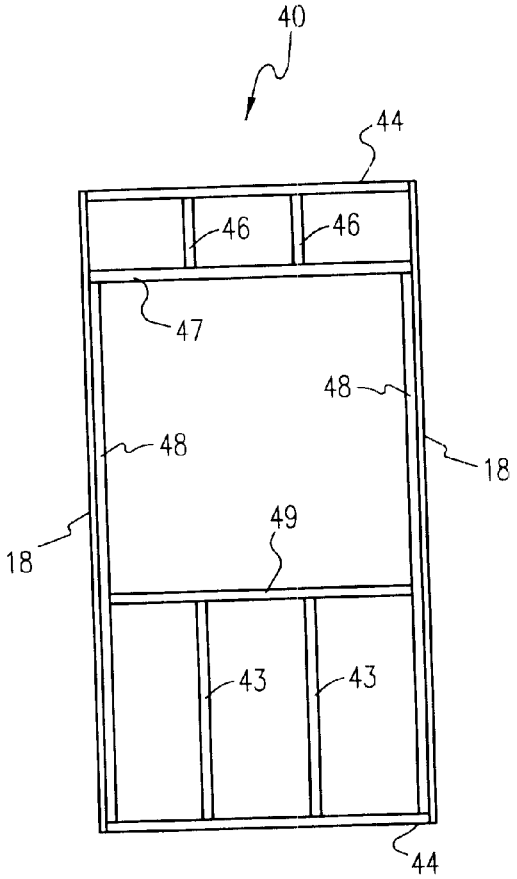
FIGS. 4*a* and 4*b* are front elevational and perspective views respectively of a window module for use with the modularized structure framing system according to the preferred embodiment of the present invention.
Figure 4B:
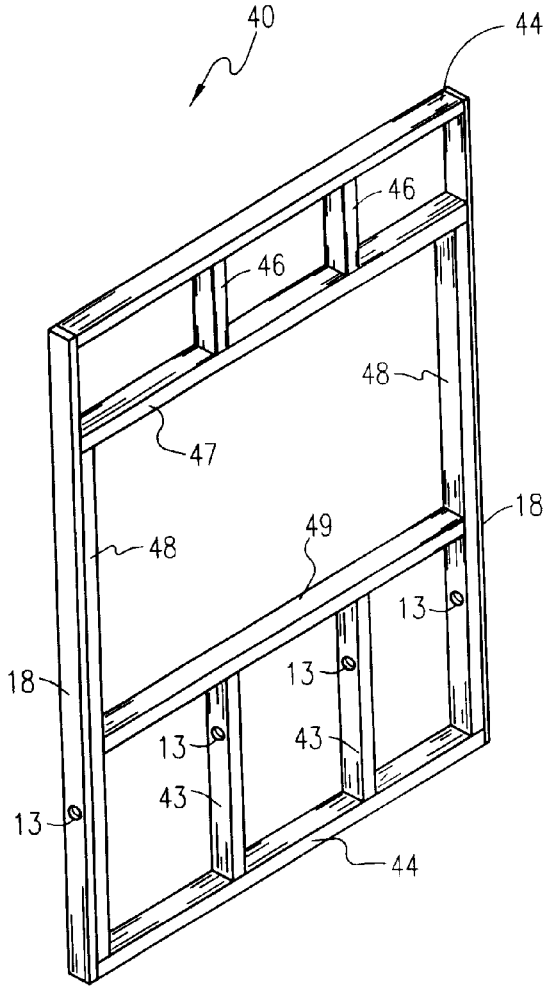
Figure 5A:
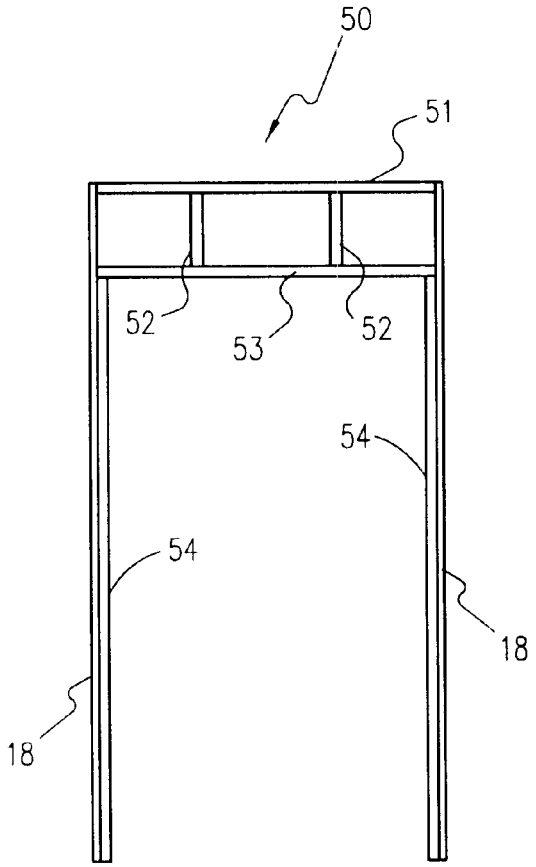
FIGS. 5*a* and 5*b* are front elevational and perspective views respectively of a door module for use with the modularized structure framing system according to the preferred embodiment of the present invention.
Figure 5B:
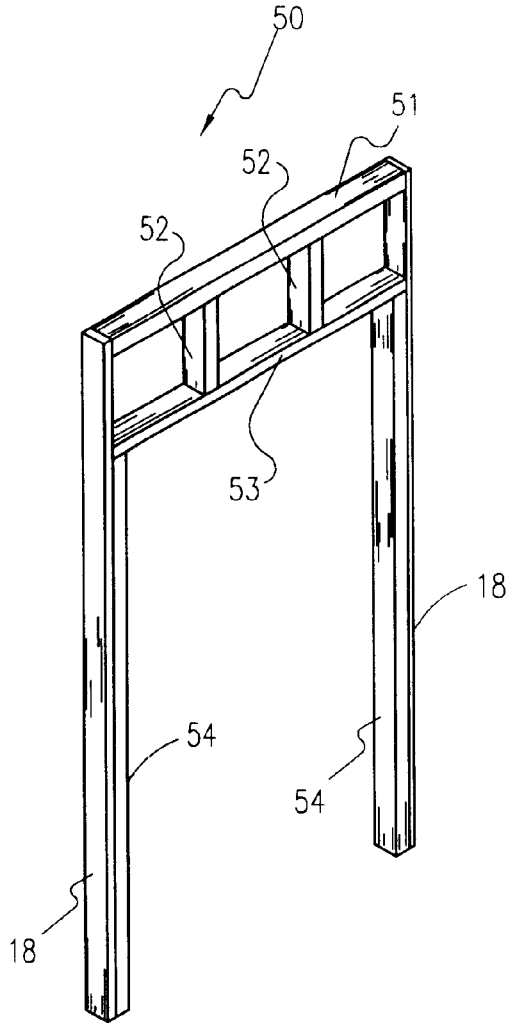

The best mode for carrying out the invention is presented in terms of its preferred embodiment, herein depicted within the Figures. The modularized structure framing system according to the preferred embodiment of the present invention incorporates:

a plurality of quad wall modules (FIGS. 1*a* and 1*b*), a plurality of single wall modules (FIGS. 2*a* and 2*b*), a plurality of double wall modules (FIGS. 3*a* and 3*b*), a plurality of window modules (FIG. 4), and a plurality of door modules (FIG. 5).

Figure 1A:
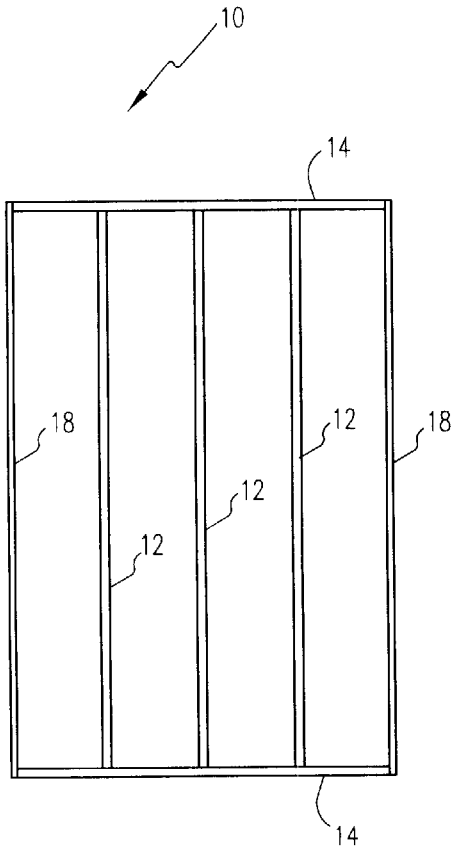
FIG. 1*a* is a front elevational view of a quad wall module for use with the modularized structure framing system according to the preferred embodiment of the present invention.
Figure 1B:
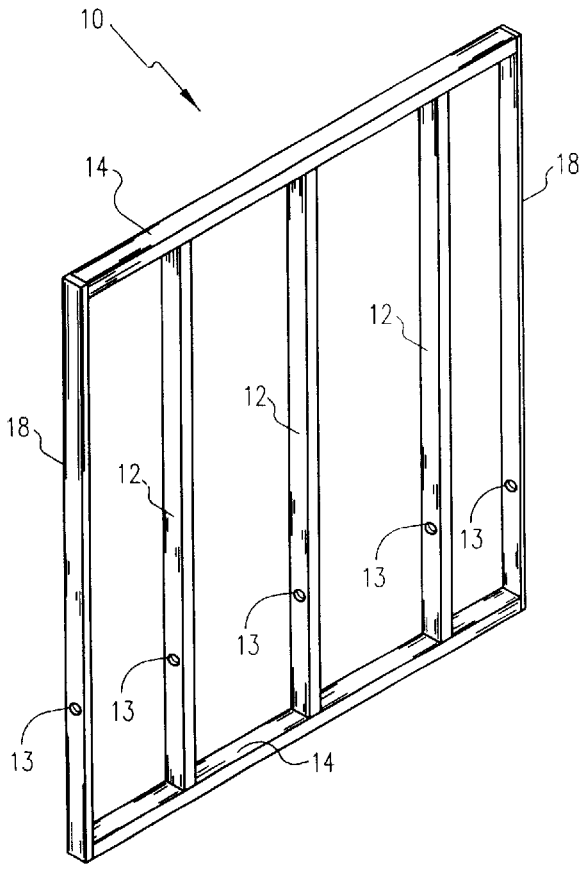
FIG. 1*b* is a perspective view of the quad wall module depicted in FIG. 1*a;*

Referring now to FIG. 1*a* and FIG. 1*b*, a quad wall module 10 is shown constructed of precut 2" by 4" studs and 1" by 4" framing strips. It is envisioned that a typical quad wall module 10 would have an overall outer dimension of approximately 94½ inches tall by 64 inches wide. Although materials of construction may vary according to local building codes, it is envisioned that internal studs 12, and a first top and bottom stringer 14 would be comprised of standard size (such as 2" by 4") wood or steel framing material, or any other suitable material that meets building code requirements. A pair of endpieces 18 are affixed at each end to the top and bottom stringers 14 using nails or any other suitable fastening device. It is envisioned that each endpiece 18 would be comprised of a similar standard size building material of a 1"×4" dimension, such that when two consecutive modules are aligned end to end two adjacent endpieces 18 align together.

Each vertical precut stud 12 and endpiece 18 form a wiring orifice 13 penetrating through the stud 12 and endpiece 18. Although other variations are envisioned, it is felt that a 1¼ inch hole penetrating at a height of approximately one foot from the bottom would allow for routing of electrical wiring later during construction.

Figure 2A:
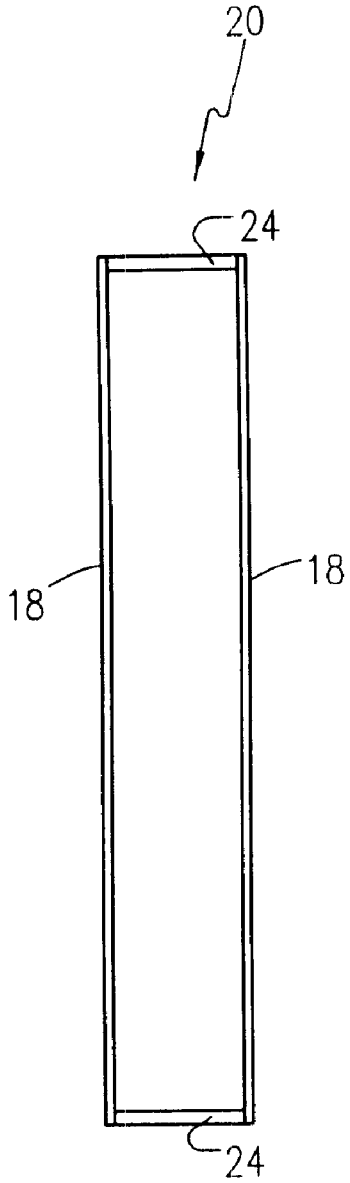
FIG. 2*a* is a front elevational view of a single wall module for use with the modularized structure framing system according to the preferred embodiment of the present invention.
Figure 2B:
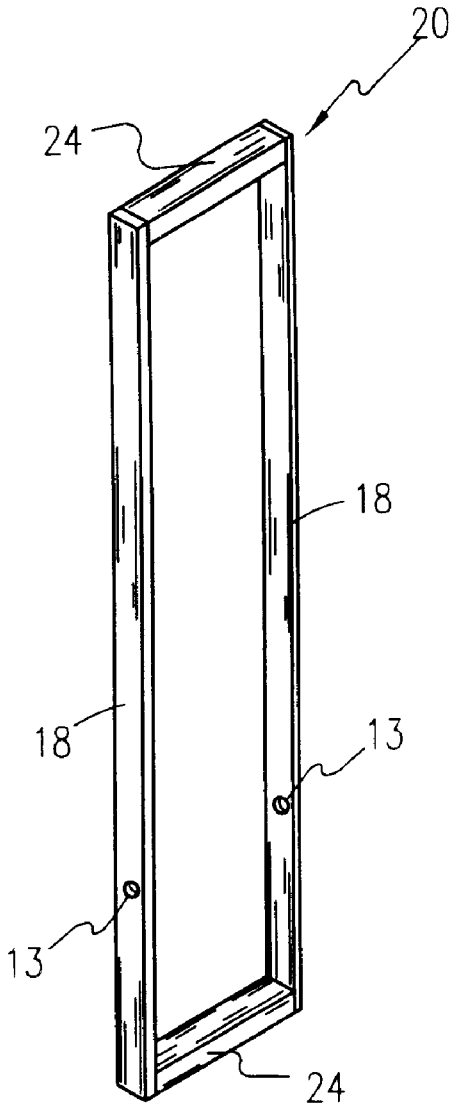
FIG. 2*b* is a perspective view of the single wall module depicted in FIG. 2*a;*

Referring now to FIG. 2*a* and FIG. 2*b*, a single wall module 20 is shown, similarly constructed of precut 2" by 4" studs and 1" by 4" framing strips. It is envisioned that a typical single wall module 20 would have an overall outer dimension of approximately 94½ inches tall by 16 inches wide. Although materials of construction may vary according to local building codes, it is envisioned that a second top and bottom stringer 24 would be comprised of standard size, such as 2" by 4", wood or steel framing material, or any other suitable material that meets building code requirements. A pair of endpieces 18 are affixed at each end to the top and bottom stringer 24 using nails or any other suitable fastening device. It is envisioned that each endpiece 18 would be comprised of a similar standard size building material of a 1"×4" dimension, such that when two consecutive modules of any type are aligned end to end two adjacent endpieces 18 align together.

Each endpiece 18 forms a wiring orifice 13 penetrating through the endpiece 18. Although other variations are envisioned, it is felt that a 1¼ inch hole penetrating at a height of approximately one foot from the bottom would allow for routing of electrical wiring later during construction.

Figure 3A:
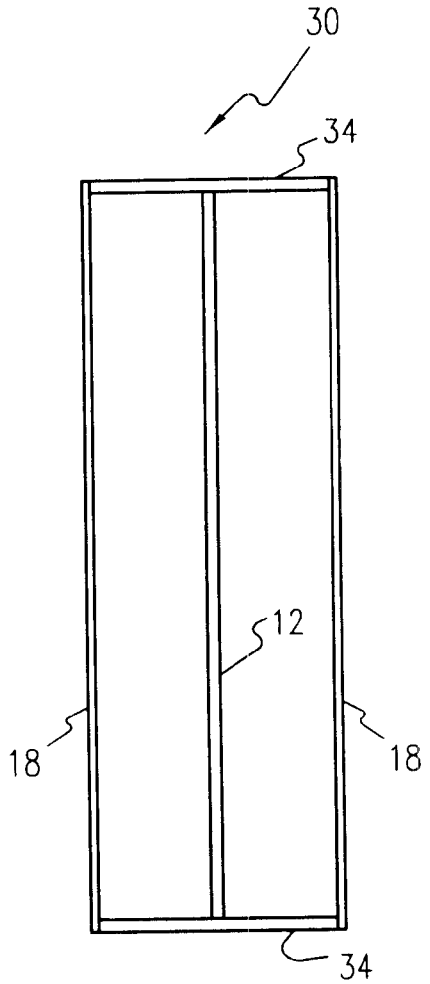
FIG. 3*a* is a front elevational view of a double wall module for use with the modularized structure framing system according to the preferred embodiment of the present invention.
Figure 3B:
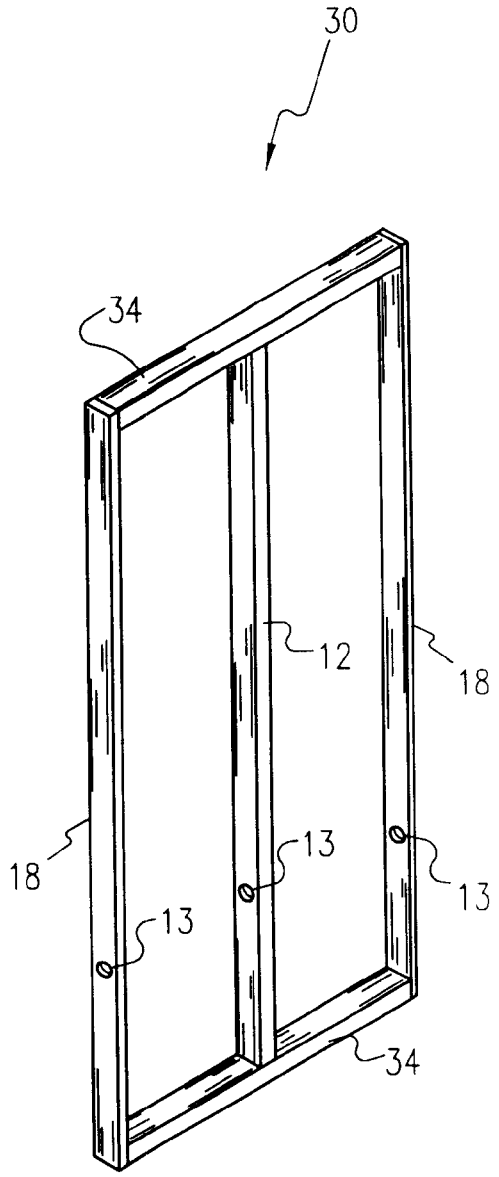
FIG. 3*b* is a perspective view of the double wall module depicted in FIG. 3*a;*

Referring now to FIG. 3*a* and FIG. 3*b*, a double wall module 30 is shown constructed of precut 2" by 4" studs and 1" by 4" framing strips. It is envisioned that a typical double wall module 30 would have an overall outer dimension of approximately 94½ inches tall by 32 inches wide. Although materials of construction may vary according to local building codes, it is envisioned that internal studs 12 and a third top and bottom stringers 34 would be comprised of standard size, such as 2"×4", wood or steel framing material, or any other suitable material that meets building code requirements. A pair of endpieces 18 are affixed at each end to the top and bottom stringers 34 using nails or any other suitable fastening device. It is envisioned that each endpiece 18 would be comprised of a similar standard building material of a 1"×4" dimension, such that when two consecutive modules are aligned end to end two adjacent endpieces 18 align together.

Each vertical precut stud 12 and endpiece 18 forms a wiring orifice 13 penetrating through the stud 12 and endpiece 18. Although other variations are envisioned, it is felt that a 1¼ inch hole penetrating at a height of approximately one foot from the bottom would allow for routing of electrical wiring later during construction.

Referring now to FIGS. 4*a*, and 4*b*, a window module 40 is shown constructed of precut 2" by 4" studs and 1" by 4" framing strips. It is envisioned that a typical window module 40 would have an overall outer dimension of approximately 94½ inches. Due to variations is window sizes, the overall width of the window module 40 must be adaptable to accommodate such changes. Although materials of construction may vary according to local building codes, it is envisioned that a fourth top and bottom stringer 44, at least two upper cripple studs 46, a header base 47, at least two header side support studs 48, a window opening bottom 49, and at least two lower cripple studs 43 would be comprised of standard size, such at 2" by 4", wood or steel framing material, or any other suitable material that meets building code requirements. A pair of endpieces 18 are affixed at each end to the fourth top and bottom stringers 44 using nails or any other suitable fastening device. It is envisioned that each endpiece 18 would be comprised of a similar standard building material of a 1"×4" dimension, such that when two consecutive modules are aligned end to end two adjacent endpieces 18 align together. It is further envisioned that headers may be constructed in accordance with any accepted technique used in the building industry.

Each header support stud 48, lower cripple stud 43 and endpiece 18 forms a wiring orifice 13 penetrating through the header support studs 48, lower cripple stud 43 and endpiece 18. Although other variations are envisioned, it is felt that a 1¼ inch hole penetrating at a height of approximately one foot from the bottom would allow for routing of electrical wiring later during construction. It is felt that field modifications will be required for installations where window dimensions interfere with the wiring orifice 13.

Referring now to FIG. 5, a door module 50 is shown for use in conjunction with the above described modules. As with the window module 40, it is envisioned that a typical door module 50 would have an overall outer dimension of approximately 94½ inches tall. Due to variations in door sizes, the overall width of the door module 50 must be adaptable to accommodate such changes. Although materials of construction may vary according to local building codes, it is envisioned that a sixth top strut 51, cripple studs 52, header base 53, and at least two header support studs 54 would be comprised of standard size, such as 2" by 4", wood or steel framing material, or other material that satisfies building code requirements. A pair of endpieces 18 are affixed at each end to the top stringer 51, header base 53 and header support studs 54 using nails or any other suitable fastening device. It is envisioned that each endpiece 18 would be comprised of a similar standard building material of a 1"×4" dimension, such that when two consecutive modules are aligned end to end two adjacent endpieces 58 align together. Again, it is further envisioned that headers may be constructed in accordance with any accepted technique used in the building industry.

Figure 6C:
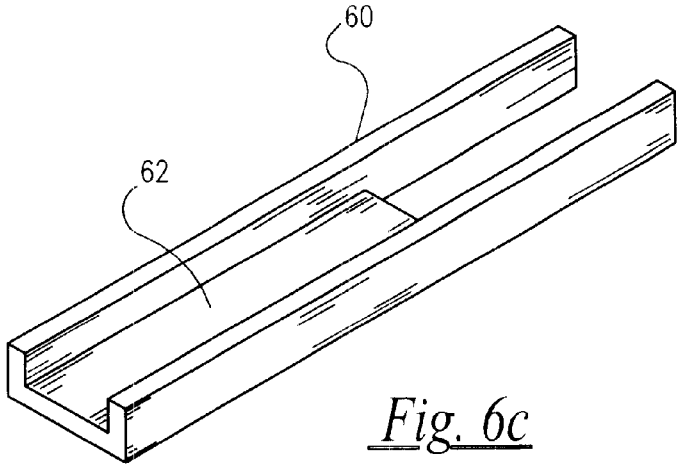
FIGS. 6*a*, 6*b*, and 6*c* are bottom plan, side elevational, and perspective views of a wall straightness alignment tool for use with the modularized structure framing system according to the preferred embodiment of the present invention.
Figure 6A:
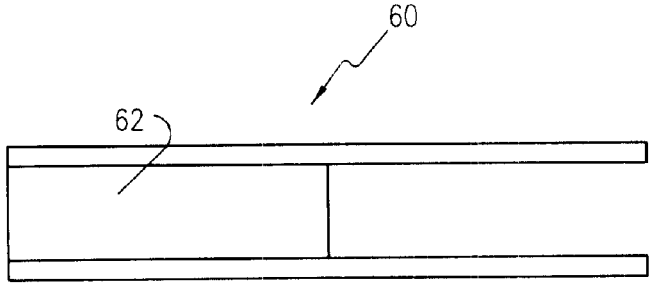
Figure 6B:
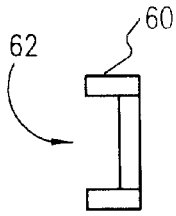
Figure 7C:
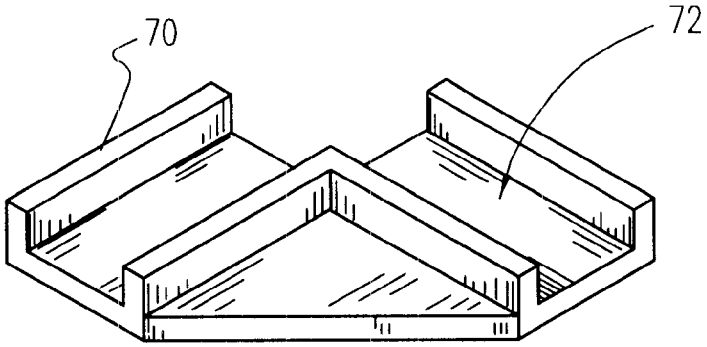
FIGS. 7*a*, 7*b*, and 7*c* are bottom plan, side elevational, and perspective views respectively of a corner alignment tool for use with the modularized structure framing system according to the preferred embodiment of the present invention.
Figure 7A:
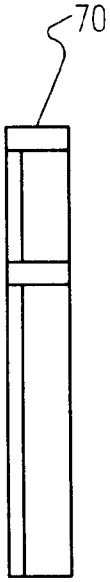
Figure 7B:
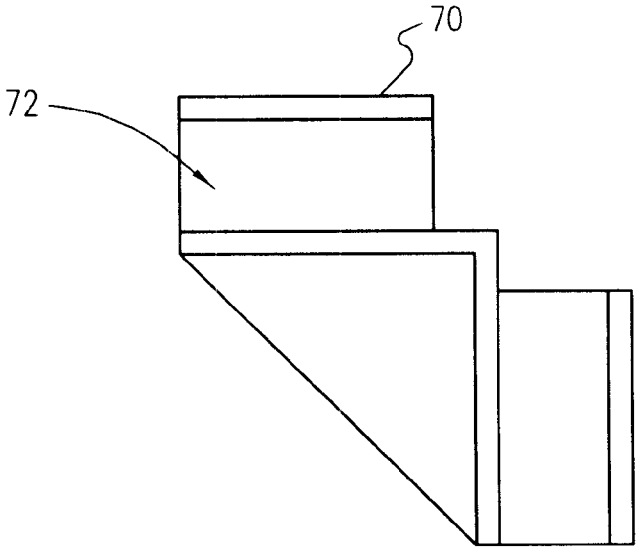
Figure 8C:
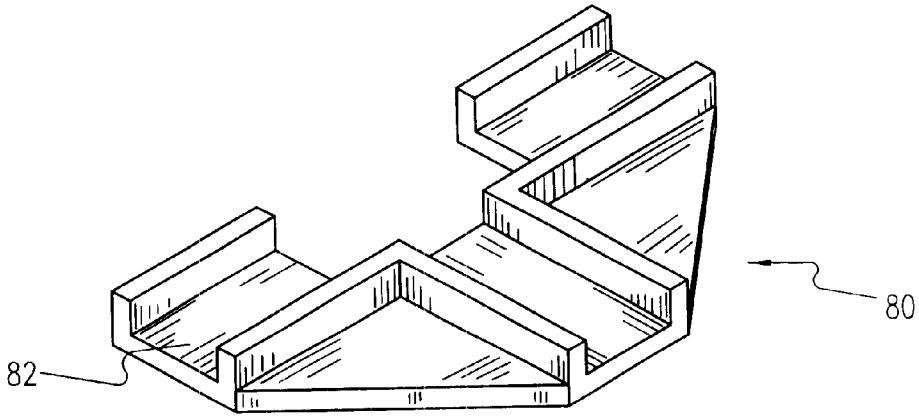
FIGS. 8*a*, 8*b*, and 8*c* are bottom plan, side elevational, and perspective views of an intersection alignment tool for use with the modularized structure framing system according to the preferred embodiment of the present invention.
Figure 8A:
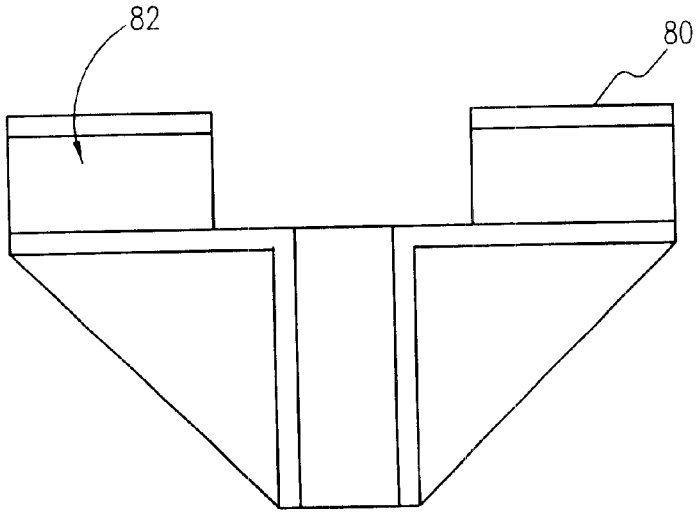
Figure 8B:
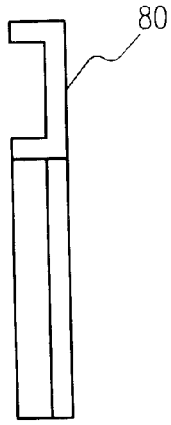

Further, a plurality of alignment tools are provided for installation for the above modules. A wall straightness tool 60 as shown in FIGS. 6*a*–6*c* has a 3.55 inch wide by 1.25 inch deep groove 62, as does the corner alignment tool 70 of FIGS. 7*a*–7*c*, indicated as 72, and the "T"-shaped wall alignment tool 80 of FIGS. 8*a*–8*b*, indicated as 82.

2. Operation of the Preferred Embodiment

To use the present invention for constructing a structure of preset plans, the framer erects the modules to complete framing within a single day. To dry-in the structure within 2 to 3 days, the following sequence is followed. To begin, a corner is assembled by mounting the two sides of the corner over the mounting bolts and placing a corner post assembly where the sides come together. Using the corner alignment tool, the framer checks to ensure the corner is at a right angle. Verticality of both sides is checked. They are then attached to the corner post assembly using screws. Verticality is rechecked and 1"-by-4" braces are attached to the outside surface of each module. These braces can be removed after the first section including the interior walls is completed. Wall, window and door modules are then added in both directions as specified until an interior wall is reached. As the modules are set in place, a wall alignment tool is placed on the top and bottom to ensure the assembly remains straight, and the modules are then fastened together using screws. The alignment tool on the top remains in place until a cap plate is installed.

The interior wall is started by locating the partition exterior wall intersection assembly in the proper location and using the "T" shaped wall alignment tool to hold it in place while verticality is checked. While screws are used to fix the assembly in place, nails are used to complete installation.

The interior walls are completed in the same fashion while the next exterior wall sections are erected. Cap plates are then installed when practical and erection continues by extending the exterior walls until the next interior wall is reached, where the process is repeated until framing is complete. If a door or window location or a wall length does not come out to the exact length of a wall module, then the shortest wall module that will exceed the exact location is cut to ¾" less than the exact length, and a 1"-by-4" is attached to the end to make the wall the required length.

Once the first section of the structure that includes the exterior walls and all interior walls is completed, the roofers can start installing the roof trusses (about two hours after the start of erection). By the end of the day, the framing is complete and the majority of the roof trusses are installed.

On the second day, the installation of the roof trusses is completed and the roof is installed. During this time, the exterior sheathing is installed. By the end of the second day or during the third day, the structure is completely "dried in".

The only framing construction done on-site is corner post assemblies, partition exterior wall intersection corner assemblies, plumbing vents and drains, utility runs, and door or window modules that are not standard sizes.

The foregoing description is included to illustrate the operation of the preferred embodiment and is not meant to limit the scope of the invention. The scope of the invention is to be limited only by the following claims.

What is claimed is:

1. A modularized structure framing system comprising a kit comprised of:

at least one quad wall module;

at least one single wall module;

at least one double wall module; and at least one door module;

said quad wall module, said single wall module, said double wall module, and said door module each connected to create a building frame for a structure;

said kit further comprising a plurality of alignment tools for erection of said quad wall module, said single wall module, said double wall module, and said door module wherein said alignment tools permit quick and accurate connection of the modules, at the appropriate angles to each other while the modules are positioned in the alignment tools;

wherein said alignment tools include a wall straightness tool and a corner alignment tool;

said wall straightness tool forms a groove 3.55 inch wide by 1.25 inch deep running throughout, said wall straightness tool configured to allow for a standard 2×4 to be inserted into said wall straightness tool flat, so that said wall straightness tool holds the connection points of two standard 2×4 pieces in horizontal linear alignment along their respective elongated centerlines; and said corner alignment tool has a 90 degree angle and forms a groove 3.55 inches wide by 1.25 inches deep running throughout to allow for a standard 2×4 to be inserted into said corner alignment tool flat, so that said corner alignment tool holds the connection point of two standard 2×4 pieces in perpendicular alignment along their respective elongated centerlines.

* * * * *